US009468353B2

(12) United States Patent
McBride, Jr. et al.

(10) Patent No.: US 9,468,353 B2
(45) **Date of Patent: *Oct. 18, 2016**

(54) FLUID APPLICATOR AND MOPPING SYSTEM

(71) Applicant: Contec, Inc., Spartanburg, SC (US)

(72) Inventors: John S. McBride, Jr., Spartanburg, SC (US); Jackson S Burnett, III, Spartanburg, SC (US)

(73) Assignee: CONTEC, INC., Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/675,561

(22) Filed: Mar. 31, 2015

(65) Prior Publication Data

US 2015/0201821 A1 Jul. 23, 2015

Related U.S. Application Data

(63) Continuation of application No. 13/789,103, filed on Mar. 7, 2013, now Pat. No. 8,990,998.

(60) Provisional application No. 61/609,001, filed on Mar. 9, 2012.

(51) Int. Cl.
*A47L 13/22* (2006.01)
*A47L 13/256* (2006.01)

(52) U.S. Cl.
CPC ..... *A47L 13/22* (2013.01); *A47L 13/256* (2013.01)

(58) Field of Classification Search
CPC ..... A47L 13/20; A47L 13/22
USPC ..... 15/228, 223, 118, 209.1, 104.94; 401/137, 139, 268, 272
See application file for complete search history.

(56) References Cited

U.S. PATENT DOCUMENTS

| | | | | |
|---|---|---|---|---|
| 5,704,723 | A * | 1/1998 | Salisian | A47K 7/03 401/201 |
| 2010/0263152 | A1 | 10/2010 | Wildeman | |
| 2010/0263154 | A1 | 10/2010 | Wildeman et al. | |
| 2011/0010883 | A1* | 1/2011 | Lindblad | A47L 13/16 15/209.1 |
| 2011/0146017 | A1 | 6/2011 | Wildeman | |
| 2012/0323197 | A1 | 12/2012 | Wildeman et al. | |

OTHER PUBLICATIONS

Aplix 946 hook product data sheet (two pages) published at www.aplix.com.
Aplix 200 loop product data sheet (two pages) published at www.aplix.com.

* cited by examiner

*Primary Examiner* — Monica Carter
*Assistant Examiner* — Andrew A Horton
(74) *Attorney, Agent, or Firm* — J. M. Robertson, LLC

(57) ABSTRACT

A mopping system incorporating a multi-use absorptive storage reservoir of fluid retaining material for retention and pressure-induced expulsion of treatment solution to a surface being treated in combination with an independently removable cleaning pad of fibrous construction. The storage reservoir and cleaning pad are adapted to releaseably engage one another in juxtaposed relation such that the cleaning pad may be readily replaced during a treatment operation.

8 Claims, 3 Drawing Sheets

FIG. —1—

FLUID APPLICATOR AND MOPPING SYSTEM

CROSS-REFERENCE TO RELATED APPLICATIONS

This non-provisional application is a continuation of U.S. patent application Ser. No. 13/789,103 and claims the benefit of, and priority from, U.S. provisional application 61/609,001 filed Mar. 9, 2012. The contents of such prior applications and all other documents referenced herein are hereby incorporated by reference in their entirety as if fully set forth herein.

TECHNICAL FIELD

The present disclosure relates generally to cleaning systems for floors and other surfaces, and more particularly, to a mopping system including an absorptive fluid reservoir structure adapted to removeably engage a mop mandrel. The fluid reservoir structure is adapted to store and selectively disperse a disinfecting and/or cleaning treatment solution to a surface being treated. The reservoir structure is further adapted to engage an independently removable cleaning pad adapted to treat the surface being cleaned and to collect the used solution as cleaning takes place while substantially isolating such used solution from the reservoir structure.

Exemplary non-limiting environments of use may include clean rooms, pharmaceutical laboratories, hospitals, and the like. The system enables a user to clean flooring and other surfaces without introducing dirt to the cleaning or disinfecting solution either from dirty laundered mops or from the surface being cleaned. The system may also facilitate the staged, sequential cleaning different zones such as a hospital patient room followed by a bathroom and then discarding the soiled cleaning pad substantially without the need for physical contact of the soiled cleaning pad by the user.

BACKGROUND

It is well known to use cleaning and disinfecting solutions to treat various environments such as healthcare environments, food preparation and manufacturing areas, electronics and pharmaceutical clean rooms. Such treatment solutions are typically applied using foam or fiber mops which collect the treatment solution from a bucket or other bulk storage device. The mop is then used to disperse the treatment solution to the surface being cleaned and to collect the used treatment solution after it has been applied. These traditional mop structures ma thus lead to substantial recycling of contaminated or diluted treatment solution as it is expelled and then drawn back into the mop during multiple cycles. This process may lead to the undesired application of such contaminated or diluted treatment solution rather than the desired application of full strength fresh solution. This situation may be particularly problematic if the operator does not collect fresh solution from the bucket on a regular basis during the treatment operation.

Proper cleaning protocol in sensitive environments such as hospitals and the like is typically a two-step process. First, a cleaning step is carried out to remove soil load. Following the cleaning step, a disinfecting step is conducted in which the flooring surface is wetted with an adequate amount of disinfecting solution to maintain a dwell time satisfactory to achieve disinfection. It is typical to use a common solution for both cleaning and disinfecting, although distinct targeted solutions may be used if desired.

The use of disposable or washable mop pads incorporating microfiber cleaning surfaces of polyester or other fibers is known. Such microfiber structures are known to provide excellent cleaning due to the particle collection characteristics associated with the high surface area of the microfiber elements. In some environments, such mops are used with a single bucket of a combined cleaning and disinfecting, solution and the mop is saturated with an amount of solution intended to be adequate for both cleaning and disinfecting. However, a typical problem encountered is the inadequate saturation of the microfiber mop head due to the generally hydrophobic nature of the microfiber. With inadequate saturation, the mop head often cannot be used for the cleaning step and still retain enough solution to properly wet the floor for disinfecting purposes. Returning the mop head to the bucket to collect additional solution may be problematic due to the possibility for contamination of the solution. In some environments, a two bucket system is used in which a so called "charger bucket" is used to saturate mops used in cleaning and then a second bucket is used for disinfectant. However, the disinfecting bucket is still exposed to soiled mops which may introduce organic matter and contamination.

In light of these deficiencies, a useful advancement would be derived from a system providing adequate fluid retention to avoid the need for resaturation while also providing the cleaning benefits associated with microfiber structures.

SUMMARY OF THE DISCLOSURE

The present disclosure provides advantages and alternatives over the prior art by providing a mopping system incorporating a multi-use storage reservoir of foam or other suitable material for retention and selective expulsion of fresh treatment solution to a surface being treated in combination with an independently removable cleaning pad of fibrous construction. The storage reservoir and cleaning pad are adapted to releaseably engage one another in juxtaposed relation such that the cleaning pad may he readily replaced during a treatment operation. Moreover, the storage reservoir is adapted to releaseably engage a mop head or other user manipulated support structure such that the storage reservoir may be readily replaced after single or multiple uses as may be desired.

In accordance with one exemplary construction, the present disclosure provides a mopping system adapted to reo ace recycling and transportation of contaminants during use. The mopping system includes a user manipulated handle operatively connected to a mop head. A first plurality of hooking elements defining one half of a hook and loop connection extends downwardly away from an underside surface of the mop head. The mopping system further includes a multi-layer fluid reservoir block adapted for releasable attachment to the first plurality of hooking elements. The fluid reservoir block includes a fluid retaining body with a backing layer disposed above the fluid retaining body defining a plurality of loops adapted to engage the first plurality of hooking elements to establish a first hook and loop connection. The fluid reservoir block further includes is substantially fluid impermeable polymeric film layer disposed across a lower surface of the fluid retaining body facing away from the backing layer, the polymeric film layer includes a second plurality of hooking elements projecting in a direction away from the fluid retaining body. A cleaning pad is adapted for removable hook and loop connection to the second plurality of hooking elements. The cleaning pad includes an outer surface layer including a plurality of microfiber surface loops. The cleaning pad further includes a fibrous fluid wicking layer secured to the outer surface layer and facing away from the surface loops. The fluid wicking layer defines a plurality of fiber loops adapted to engage the second plurality of hooking elements to establish a second book and loop connection holding the cleaning pad in attached relation to the fluid reservoir block. The peal strength of the first hook and loop connection is at least 2 times the peal strength of the second hook and loop connection.

BRIEF DESCRIPTION OF THE DRAWINGS

The accompanying drawings which are incorporated in and which constitute as part of this specification illustrate exemplary constructions and procedures in accordance with the present disclosure and, together with the general description of the disclosure given above, and the detailed description set forth below, serve to explain the principles of the disclosure wherein.

While the disclosure has been illustrated and will hereinafter be described in connection with certain exemplary embodiments and practices, it is to be understood that in no event is the disclosure to be limited to such illustrated and described embodiments and practices. On the contrary, it is intended that the present disclosure shall extend to all alternatives and modifications as may embrace the general principles of this disclosure within the fill and true spirit and scope thereof.

DESCRIPTION OF THE PREFERRED EMBODIMENTS

Figure 1:
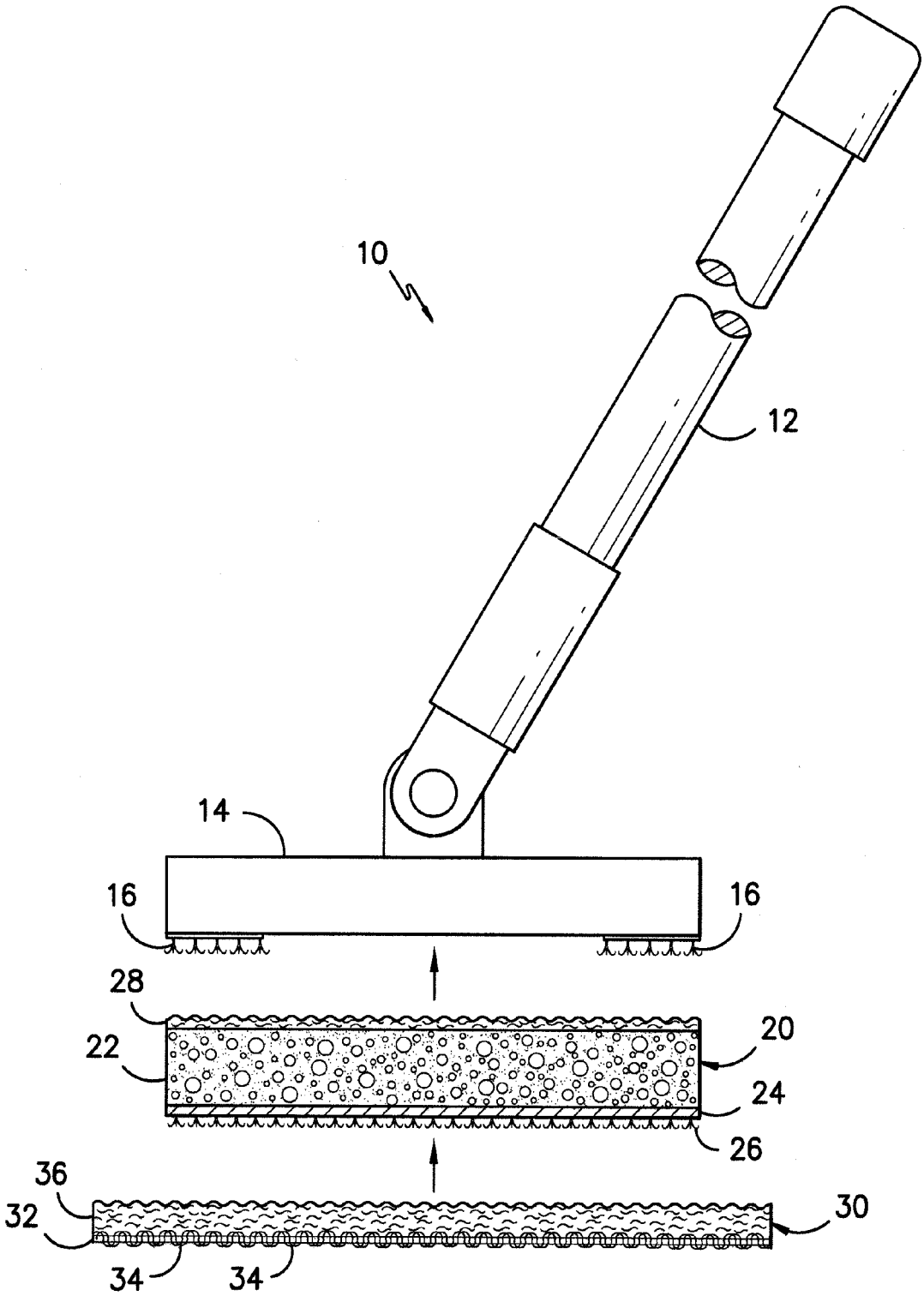
FIG. 1 illustrates schematically an assembly view of a mopping system in accordance with one exemplary embodiment of the present disclosure incorporating a mop head, a fluid reservoir block and a cleaning pad.
Figure 2:
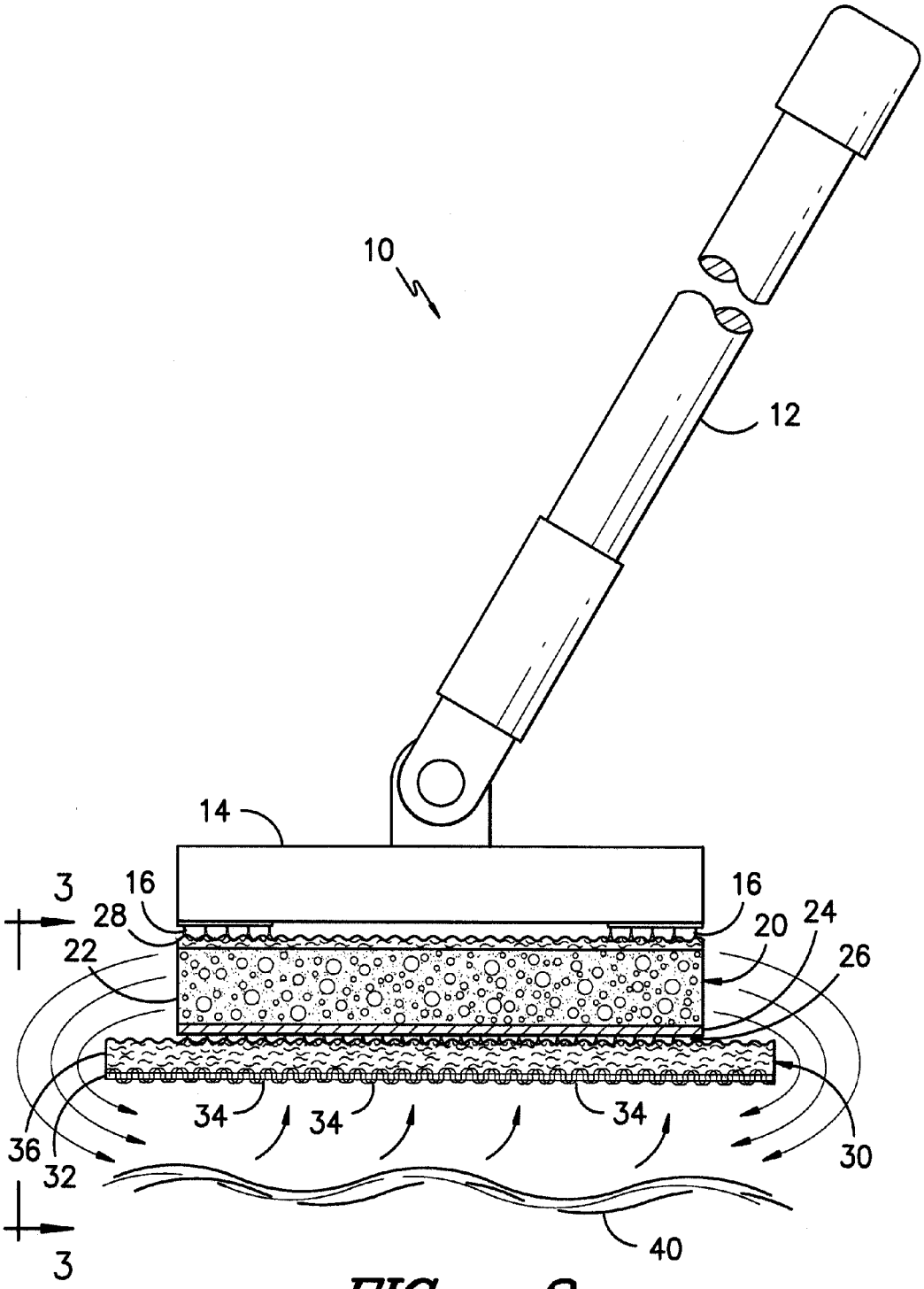
FIG. 2 is a fully assembled side view similar to FIG. 1, illustrating an exemplary pattern of fluid discharge from the fluid reservoir block and take-up by the cleaning pad.
Figure 3:
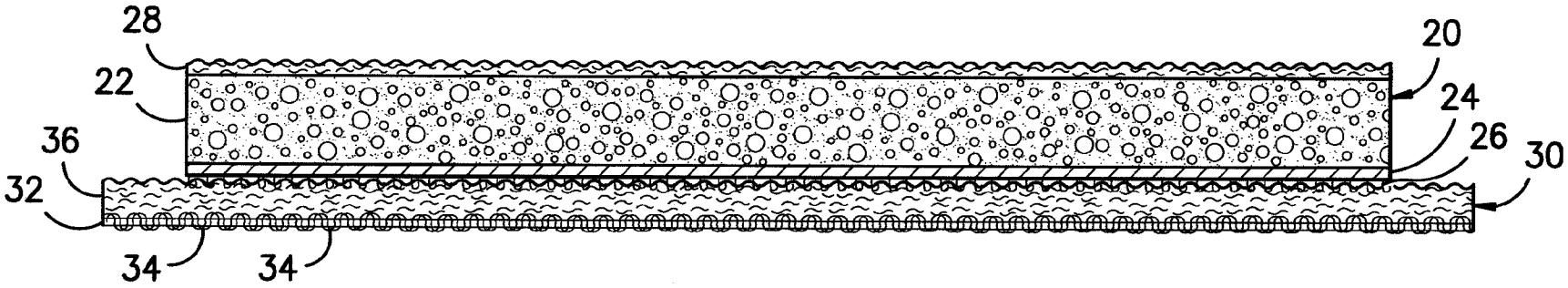
FIG. 3 is an end view taken generally along line 3-3 in FIG. 2.

Turning now to the drawings, FIGS. 1-3 illustrate an exemplary embodiment for a mopping system 10 in accordance with the present disclosure. As shown, in this exemplary embodiment a user manipulated handle 12 is operatively connected to a mop head 14 as will be well known to those of skill in the art. As best seen in FIG. 1, the underside of the mop head may include an arrangement of hooking elements 16 defining one half of a hook and loop attachment structure. By way of example only, and not limitation, the hooking elements 16 across the underside of the mop bead 14 may project away from a film backing which is secured to the underside of the mop head by an adhesive or by other suitable technique as may be desired. The hooking elements 16 may be disposed in a discontinuous pattern across the underside of the mop head 14 or may be substantially continuous.

The individual hooking elements 16 typically have a shaft portion which extends roughly perpendicularly from the underside of the mop head 14 and a free end extending from the shaft portion that is curved or enlarged in a mushroom shape or the like to enable engagement with a corresponding loop on an element to be attached. Virtually any hook shape can be used. By way of example only, and not limitation, the individual booking elements 16 can have J-shaped free ends, double hook free ends or generally Bat enlarged heads having a mushroom shape or the like. The hooking elements 16 are typically formed from a relatively stiff resilient polymer to provide a relatively high peal force in a connection between the mop head and an underlying structure to be attached. In this regard, "peel force" refers to a force required to pull two adjoining bodies away from one another in opposite directions generally perpendicular to a plane in which the bodies are joined. Peel force may also be referred to as "fastening strength."

By way of example only, and not limitation, the hooking elements 16 may be disposed in localized zones across the underside of the mop head 14 at concentrations within those zones of about 50 to about 2500 hooks per square inch. The hooking elements 16 are suitably molded or extruded from a thermoplastic polymer selected from polyamides, polyesters, polyolefins (e.g. polypropylene or polyethylene) or another suitable material that contributes strength and/or friction to the fastening system. Likewise, any film backing supporting the hooking elements 16 may be made of any of these or other suitable materials.

According to the contemplated practice, the hooking elements 16 may connect in a releasable manner to the upper surface of a fluid reservoir block structure 20. By way of example only, and not limitation, the fluid reservoir block structure 20 may have a fluid retention body 22 disposed in adjacent relation above a substantially fluid impermeable polymeric film layer 24. The fluid retention body 22 may be formed from any suitable fluid retaining material including porous cellular foam or a substantially less porous cellular or noncellular material including internal channels or other interior voids which act to hold a treatment fluid until the application of pressure causes expulsion of the treatment fluid from the voids. By way of example only, and not limitation, the fluid retention body 22 and the film layer 24 may be joined by techniques such as adhesive or melt bonding as may be desired. With such joining complete, fluid is substantially blocked from passing through the film layer 24. The film layer 24 may substantially cover the entire lower surface of the fluid retention body 22. As shown, in the exemplary construction, an arrangement of micro-hooks 26 may project away from the surface of the ant layer 24 facing away from the fluid retention body 22. In this regard, it is to be understood that the relative dimensions of the elements illustrated in the figures are not to scale and that the micro-hooks 26 are substantially smaller than the hooking elements 16 so as to provide a such lower gripping force as will be described further hereinafter.

By way of example only, the film layer 28 and micro-hooks 26 may be in the form of a unitary hooking substrate material. One suitable liquid impermeable film layer 24 with outwardly projecting extruded polypropylene mushroom micro-hooks is believed to be available as style No. 946 available from Aplix Corporation in Charlotte, N.C. However, other suitable materials with different hooking structures may likewise be used if desired.

As indicated in United States published application 20080222856 (incorporated by reference) micro-hook fastening materials in which a plurality of hooking elements made in one piece in the form of stalks which have thickenings located on the hooking or front side of the backing support are known. in one exemplary production process, a thermoplastic, especially polyesters, polyolefin or polyamide, in the plastic or liquid state is supplied to the gap between the pressing tool and a molding tool. The shaping element on the molding tool is a screen with continuous cavities and the hooking elements are formed by the thermoplastic which at least partially hardens in the cavities of the screen. In this way a so-called micro-hook fastener may be formed with the film layer 24 forming a backing with a thickness from 0.1 mm to 0.3 mm. Of course, thicker or thinner backings may likewise be used if desired.

In order to facilitate attachment of the fluid reservoir block 20 to the mop head 14, a fibrous backing layer 28 may be secured across the side of the absorbent body 22 facing away from the micro-hooks 26. Operative connection of the backing layer 28 in place across the fluid reservoir block 20 may be by any suitable technique including adhesive bonding, flame lamination or the like. As will be appreciated, the fibrous backing layer 28 defines a multiplicity of loops formed by its fiber constituents for releasable attachment to the hooking elements 16. Accordingly the reservoir block structure 20 may be secured in a releasable manner across the underside of the mop head 14.

By way of example only, one suitable backing layer 28 may be a knit polyamide, polyolefin or polyester fabric with slightly napped loops across one face and a mass per unit area of about 100 to about 400 grams per square meter. One such material is believed to be available as style No. 200 from Aplix Corporation in Charlotte, N.C. However, other suitable materials may likewise be used if desired. By way of example only, and not limitation, alternative materials for the backing layer may include thermal bond and/or needled nonwoven structures of polyester, polyolefin or polyamide fibers as well as other nonwoven materials. It may be desirable for the backing layer 28 to be formed from a material of substantially hydrophobic character such that it maintains a substantially dry character and does not pull fluid from the reservoir block 20 towards the mop head 14.

In accordance with a potentially preferred embodiment of the present disclosure, the mopping system 10 further includes a readily replaceable cleaning pad 30 for attachment to the underside of the reservoir block structure 20 during a cleaning operation. By way of example only, and not limitation, the cleaning pad 30 may include an outer surface layer 32 of so called "stitch bonded" construction with a plurality of microfiber yams stitched in a repeating pattern through a lightweight fibrous stitching substrate to form a pattern of surface loops 34 extending in raised relation to the stitching substrate for use in contacting the surface to be treated. The microfiber yarns used are preferably multifilament polyester yarns characterized by a denier per filament (dpf) rating of about 0.5 dpf to about 1 dpf. However, higher or lower dpf yarns may be used if desired. One exemplary pattern for the surface loops 34 is a chevron pattern. However, other patterns also may be used if desired.

In the exemplary construction of the cleaning pad 30, a fluid wicking layer 36 such as a nonwoven felt batting formed from hydrophobic polyester, polyolefin or polyamide staple fibers or the like is secured behind the outer surface layer 32. In this regard, the attachment between the fluid wicking layer 36 and the outer surface layer 32 is preferably of a character such that fluid may flow readily across the outer surface layer 32 and into the fluid wicking layer 36. Suitable exemplary joining techniques may include stitching, patterned sonic bonding and the like. By way of example only, and not limitation, one exemplary material for the fluid wicking layer 36 may be a needled felt of polyester staple fibers. However, other materials may likewise be used if desired. As will be appreciated, the fibrous surface of the fluid wicking layer 36 projecting away from the outer surface layer 32 defines a multiplicity of engagement loops for releasable capture of the micro-hooks 26. Accordingly, the cleaning pad 30 may be readily secured in a releasable manner across the micro-hooks 26 at the underside of the reservoir block structure 20 during use (FIGS. 2 and 3).

If desired, it is contemplated that the fluid wicking layer 36 may be heated by a platen or hot rolls or otherwise treated to reduce the number of hook and loop connection points across the surface relative to an untreated surface. It is also contemplated that a surface layer of loop material such as style 960 loop material from Aplix Corporation in Charlotte, N.C. or the like may be present across the upper surface of the fluid wicking layer 36 to form a connection with the micro-hooks 26.

As noted previously, a reservoir block structure 20 as described may be secured to the mop head 14 by engagement between the hooking elements 16 and the backing layer 28. The reservoir block structure 20 then may be immersed in a cleaning and/or disinfecting solution to substantially saturate the fluid retention body 22 through the sides. Thus, fluid retention body 22 is loaded with new treatment solution. Following introduction of the solution to the fluid retention body 22, a cleaning pad 30 as described above may be releasably secured in position below the reservoir block structure as shown in FIG. 2 such that the fluid impermeable film layer 24 is between the fluid retention body 22 and the fluid wicking layer 36. In this condition, treatment fluid 40 is held within the reservoir block structure, but is blocked from entering the cleaning pad 30.

As illustrated in FIG. 2, during use, the application of a compressive three to the reservoir hock structure 20 will cause treatment, fluid 40 to be expelled outwardly from the fluid retention body 22. The treatment fluid 40 may thus be deposited across a surface to be treated. As the mopping system is manipulated across the surface to be treated, the surface loops 34 of microfiber yarn provide a cleaning action to loosen and collect any solid material and the used, contaminated fluid is drawn away from the treated surface and into the fluid wicking layer 36. Thus, the surface being treated is cleaned and dried. Moreover, the contaminated fluid is blocked from reentering the foam body by the fluid impermeable film layer 24.

Once the fluid wicking layer 36 is saturated, the cleaning pad 30 may be removed and replaced with a fresh pad. The cleaning operation may then continue using a series of cleaning pads 30 until all available fluid has been expelled from the fluid retention body 22. With the cleaning pad removed, the fluid retention body 22 then may be reloaded with treatment fluid 40 from a bucket or other storage device to continue the process. Thus, used solution is substantially prevented from being recycled. Of course, a user may elect to replace the used reservoir block structure 20 at any point during the cleaning operation as may be desired.

By way of example only and not limitation, in accordance with one exemplary practice, it is contemplated that a hospital patient room and related bathroom may be cleaned with a single cleaning pad 30. In this regard, a fresh cleaning pad 30 may be attached to a saturated fluid reservoir block at the start of the cleaning process. With the fresh cleaning pad 30 in place, the user may first clean and disinfect the patient room using a portion of the stored treatment fluid 40 in the absorbent body 22 and then move on to the bathroom using the same pad and the remaining portion the stored treatment fluid. At the conclusion of cleaning and disinfecting the bathroom, the user may then dispose of the used cleaning pad 30 before moving to the next patient room. In this manner, any contaminants picked up by the cleaning pad 30 are not transferred between patient rooms. Of course, the used cleaning pad 30 also may be laundered if desired.

As illustrated in FIGS. 2 and 3, the cleaning pad 30 may have dimensions slightly larger than the opposing dimensions of the fluid reservoir block 20. Accordingly, upon attachment, an uncovered cantilevered edge of the cleaning pad 30 will be disposed outboard from the boundary edges of the fluid reservoir block 20. During use, this uncovered edge provides a zone to initiate convenient peeling removal of the cleaning pad from the overlying reservoir block 20. in this regard, it is contemplated that a user may effect removal of the cleaning pad by using the lip of a disposal bin as a wedge to act between the cleaning pad 30 and the reservoir block 20, thereby causing the cleaning pad 30 to peal away from the reservoir block and to fall into the disposal bin. Thus, no contact by the user with the soiled cleaning pad is required.

In accordance with one exemplary feature of the present disclosure, it is contemplated that the peal strength established by the connection between the hooking elements 16 and the backing layer 28 will be substantially greater than the peal strength provided by the connection between the micro-hooks 26 and the opposing surface of the fluid wicking layer 34. By way of example only, in accordance with one exemplary practice the peal strength established by the connection between the hooking elements 16 and the backing layer 28 of the fluid reservoir block may be at least 2 times the peal strength provided by the connection between the micro-hooks 26 and the opposing surface of the fluid wicking layer 36.

In accordance with another exemplary practice, the peal strength established by the connection between the hooking elements 16 and the backing layer 28 of the fluid reservoir block may be at least 3 and preferably at least 4 times the peal strength provided by the connection between the micro-hooks 26 and the opposing surface of the fluid wicking layer 36.

In accordance with another exemplary practice, the peal strength established by the connection between the hooking elements 16 and the backing layer 28 of the fluid reservoir block may be in the range of about 1 to about 6.5 inch pounds as measured in a new state in accordance with ASTM Standard 5170 and will be at least twice the peal strength provided by the connection between the micro-hooks 26 and the opposing surface of the fluid wicking layer 36. More preferably, the peal strength established by the connection between the hooking elements 16 and the backing layer 28 may be in the range of about 1 to about 5 inch pounds as measured in a new state in accordance with ASTM Standard 5170 and may be at least 3 times the peal strength provided by the connection between the micro-hooks 26 and the opposing surface of the fluid wicking layer 36. More preferably, the peal strength provided by the connection between the micro-hooks 26 and the opposing surface of the fluid wicking layer 36 may be in the range of about 0.1 to about 1 inch pounds as measured in a new state in accordance with ASTM Standard 5170 and the peal strength established by the connection between the hooking elements 16 and the backing layer 28 will be not less than 2 inch pounds as measured in a new state in accordance with ASTM Standard 5170 and.

Of course, variations and modifications of the foregoing are within the scope of the present disclosure. Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

Various features of the disclosure are set forth in the following claims.

What is claimed is:

1. A mopping system adapted to reduce recycling and transportation of contaminants during use, the mopping system comprising:

a mop head, wherein a first plurality of hooking elements defining one half of a hook and loop connection extends downwardly away from an underside surface of the mop head;

a multi-layer fluid reservoir block adapted for releasable attachment to the first plurality of hooking elements, the fluid reservoir block comprising a fluid retaining body adapted to expel retained fluid upon the application of pressure, the fluid reservoir block further including a backing layer disposed above the fluid retaining body defining a plurality of loops adapted to engage the first plurality of hooking elements to establish a first hook and loop connection holding the fluid reservoir block in attached relation to the mop head, the fluid reservoir block further including a substantially fluid impermeable polymeric film layer disposed across a lower surface of the fluid retaining body facing away from the backing layer, the polymeric film layer including a second plurality of hooking elements projecting in a direction away from the fluid retaining body; and a cleaning pad adapted for removable hook and loop connection to the second plurality of hooking elements, the cleaning pad comprising an outer surface layer, the cleaning pad further including a fibrous fluid wicking layer secured to the outer surface layer, the fluid wicking layer defining a plurality of fiber loops adapted to engage the second plurality of hooking elements to establish a second hook and loop connection holding the cleaning pad in attached relation to the fluid reservoir block.

2. The mopping system as recited in claim 1, wherein the backing layer is a knit loop fabric.

3. The mopping system as recited in claim 1, wherein the backing layer is needled felt of polyester fiber.

4. The mopping system as recited in claim 1, wherein the backing layer is a thermal bond nonwoven of polyester fiber.

5. The mopping system as recited in claim 1, wherein the second plurality of hooking elements comprises a plurality of hooks integrally molded with the polymeric film layer such that the second plurality of hooking elements and the polymeric film layer define a unitary substantially fluid-impermeable structure.

6. The mopping system as recited in claim 1, wherein the outer surface layer comprises a plurality of microfiber surface loops formed from yarns having a denier per filament ratings of about 0.5 to 1.

7. The mopping system as recited in claim 1, wherein the peal strength of the first hook and loop connection is about 1 to about 6.5 inch pounds as measured in a new state in accordance with ASTM Standard 5170.

8. The mopping system as recited in claim 7, wherein the peal strength of the second hook and loop connection is about 0.1 to about 1 inch pounds as measured in a new state in accordance with ASTM Standard 5170.

* * * * *